US007165493B2

(12) United States Patent
Behrens

(10) Patent No.: US 7,165,493 B2
(45) Date of Patent: Jan. 23, 2007

(54) TRANSPORT APPARATUS FOR PRINTING PLATES INCLUDING PLATE HOLDER HAVING TWO PARALLEL, INTERCOUPLED HOLDING DECKS

(75) Inventor: Gunnar Behrens, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 166 days.

(21) Appl. No.: 10/968,478

(22) Filed: Oct. 19, 2004

(65) Prior Publication Data

US 2005/0132916 A1 Jun. 23, 2005

(30) Foreign Application Priority Data

Dec. 18, 2003 (DE) ..... 103 59 667

(51) Int. Cl.
*B65H 29/60* (2006.01)

(52) U.S. Cl. ..... 101/477; 101/401.1; 271/225; 271/303; 271/184

(58) Field of Classification Search ..... 101/477, 101/401.1; 271/225, 298, 303, 304, 184
See application file for complete search history.

(56) References Cited

U.S. PATENT DOCUMENTS

| | | | | |
|---|---|---|---|---|
| 4,871,163 | A * | 10/1989 | Landa et al. | 271/225 |
| 4,905,595 | A | 3/1990 | Jeschke | 101/174 |
| 5,868,387 | A | 2/1999 | Kida et al. | 271/304 |
| 5,910,756 | A | 6/1999 | Ella | 333/133 |
| 5,927,713 | A * | 7/1999 | Driscoll et al. | 271/298 |
| 5,939,957 | A | 8/1999 | Iwata | 333/189 |
| 6,213,020 | B1 | 4/2001 | Kawada et al. | 101/486 |
| 6,556,103 | B1 | 4/2003 | Shibata et al. | 333/187 |
| 6,698,573 | B1 | 3/2004 | Gienger | 198/456 |
| 2002/0185798 | A1 | 12/2002 | Gienger | 269/55 |
| 2004/0150158 | A1 * | 8/2004 | Biegelsen et al. | 271/303 |

FOREIGN PATENT DOCUMENTS

| | | | |
|---|---|---|---|
| DE | 37 21 879 C2 | | 1/1989 |
| DE | 40 38 545 C2 | | 6/1992 |
| DE | 101 28 057 A1 | | 2/2003 |
| JP | 2-81857 | * | 3/1990 |
| WO | 0 880 227 A2 | | 11/1998 |
| WO | 1 170 862 A2 | | 1/2002 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A method for handling printing plates includes moving the printing plates from a first process station to a second station by a printing plate holder. The process stations are all arranged on a cylinder circumferential surface around a mid-axis, and it is possible for all to be opened out by the printing plate holder in the same way as with a distributor for the purpose of input or output. An apparatus for handling printing plates has a printing plate holder containing at least two mutually parallel, intercoupled holding decks for printing plates which can be pivoted about a common axis of rotation. The holder is located in the vicinity of the process stations and is suitable for transporting a printing plate from a first process station to a second station. Therefore, different types of printing plate can be handled manually, automatically or partly automatically in a less complex structure.

7 Claims, 5 Drawing Sheets

TRANSPORT APPARATUS FOR PRINTING PLATES INCLUDING PLATE HOLDER HAVING TWO PARALLEL, INTERCOUPLED HOLDING DECKS

BACKGROUND OF THE INVENTION

Field of the Invention

The invention relates to a method and an apparatus for handling printing plates, in particular in the region of an image setting device for imaging the printing plates.

Before printing forms, for example printing plates, can be used in the printing process, such as offset printing, they must be imaged. In order to image these printing plates, image setting devices such as external drum exposers, internal drum exposers or the like are used.

For the purpose of imaging, the printing plates are inserted into the image setting device. For this purpose, the printing plates can be laid in individually by hand or they can be removed automatically from a cassette for printing plates. The cassette can in turn be removed from a cassette store. For the automatic or semiautomatic population of an image setting device, it is possible for example for single-cassette loaders (SCL) and multi-cassette loaders (MCL) to be used. In a single-cassette loader, a cassette is loaded which originates from a multi-cassette loader or was supplied manually to the SCL. Within the SCL, a printing plate is then separated from the cassette and supplied to the image setting device. In a semiautomatic method, a cassette can also be supplied manually to the SCL.

Depending on the plate used, different image setting devices are needed. The plates can differ, for example in relation to the necessary exposure wavelength. The respective image setting devices then have to have appropriate exposure heads that, for example, contain laser diodes of suitable wavelength.

Following imaging, it can be necessary for the printing plate to be transported further into a developing unit (processor). This can be the case when the surface layer of the printing plate has not been removed ablatively during the exposure in order to produce a printed image.

By the development, depending on the plate time, the exposed or the unexposed regions of the surface layer are removed. Various chemicals or else different development times may be necessary for this purpose.

When the printing plate has been developed, it is transported into a press, clamped into an appropriate plate cylinder and can then be used in the printing process.

If the printed image is produced in an ablative image setting process, then subsequent development of the printing plate is not necessary and the plate can be clamped straight into the press (without any further processing).

Before or after the printing plate has been imaged, it can also be necessary for register holes to be punched into the printing plate. For this purpose, the printing plate is then transported into an appropriate punching apparatus. The register holes are used for in-register alignment of the printing plate in the press or else in the image setting device. In particular, different register holes can be provided for the press and the image setting device. Different presses can also predefine different register holes.

In a method for handling printing plates, in particular in the region of an image setting device for imaging the printing plates, it is therefore necessary to ensure that the printing plates are moved between the various stations through which they pass until they are clamped into a press.

If different types of printing plates are used, it should be ensured that these plates are treated in a manner corresponding to their type. For this purpose, it may be necessary for the plates then to be moved to correspondingly different image setting devices and/or development devices.

For this purpose, the printing plates can be moved between the different stations by hand by an operator. For this purpose, it can be the case that the entire process has to be carried out in a yellow light region, in order that light-sensitive plates are not wrongly exposed.

It is also possible and normally desirable for the printing plates to be transported automatically to and fro between the different stations. In this case, it may be necessary for there to be separate processing paths for different types of printing plate.

Combinations between an automatic and a manual method are also possible. For instance, a printing plate can be introduced by hand into an image setting device and then supplied automatically to a development device and developed there. It is also possible for a printing plate cassette to be inserted into an SCL by hand and for the rest of the procedure to be carried out automatically. In the case of these combinations, too, different processing paths may be necessary from the point of view of apparatus.

In order to move a printing plate automatically between two process stations, U.S. Pat. No. 6,213,020 describes a transport device which transports a printing plate first from the first transport path into a punching apparatus and then subsequently into an image setting device. Following the imaging, the printing plate can then be picked up again by a second transport path of the transport device. How this transport device is incorporated in an automatic or semiautomatic processing path is not described.

The printing plate is transported to and fro between the punching apparatus and the image setting device by the transport device described in U.S. Pat. No. 6,213,020 by the transport device being tilted. The transport device is connected to an external drive for this purpose via a complex arrangement of cams and geared disks. This drive produces a torque on the transport device via step-down mechanisms, the transport device then being tilted about a fixed point, with which the transport device is connected to an external apparatus. By this drive, the transport device can be tilted substantially between two stable states.

SUMMARY OF THE INVENTION

It is accordingly an object of the invention to provide a transport apparatus for printing plates and a method of operating the transport apparatus which overcome the above-mentioned disadvantages of the prior art methods and devices of this general type, which is of less complex construction, and can be used in a simple way in manual, semiautomatic and automatic processing paths and makes it possible to handle a large number of different types of printing plate in only one structure.

With regard to the method, the object of the invention is achieved in that at least one printing plate is moved at least temporarily by a printing plate holder from a first process station to a second process station along one of a plurality of paths. The process stations in each case are one of a plurality of process stations which are all disposed on a cylinder circumferential surface around a central axis and can all be opened out by the printing plate holder in the same way as with a distributor for the purpose of inputting or outputting the printing plates.

By this method, different process stations can advantageously be supplied with printing plates. In this case, the process stations can in particular be input stations for the inputting of the printing plates. In this case, a distinction can additionally be drawn between manual input stations and automatic input stations, for example from an SCL. Furthermore, they can also be output stations (manual and/or automatic).

Process stations can also be understood to mean image setting devices, development devices, punching apparatuses or similar apparatuses. In particular, different process stations of the same type, such as development devices for different printing plates, can be supplied with printing plates.

According to the invention, all the path combinations between the process stations are to be possible. The printing plates can then be moved on a desired path. For instance, the printing plates can be moved first from an automatic input station to an image setting device, then from the exposure device to a punching apparatus, after that to a development device and finally into an automatic output station. Following the first printing plate, a second printing plate can then be moved to a second image setting device and a second development device having characteristics different from the first process stations.

In terms of the method, provision can also be made for plates that have already been partly handled to be capable of being handled by this method. For example, a plate that has already been imaged can be transferred into the holder, manually or automatically, and then moved further into a second process station for development.

According to the invention, the process stations are to be disposed on the circumferential surface of a cylinder. In this way, a maximum of process stations can be disposed around a common mid-axis, which results in that a small base area is needed for this structure.

According to the invention, printing plates can be moved from any desired first process station on the cylinder circumferential surface to any desired second process station. The method is distinguished precisely by this high variability as regards the connection between extremely different process stations.

The method is not restricted to movement of the printing plates from and to input or output stations.

In a further development of the method, according to the invention, provision is advantageously made for the paths along which the at least one printing plate can be moved to have path ends and path starts which are respectively described by secants through a circle which are substantially independent of one another.

For this purpose, the printing plate is advantageously moved on the shortest possible paths through the volume enclosed by the cylinder circumferential surface.

The process stations are in each case located at possible path starts or ends. In this case, they do not themselves in their alignment have to point in the direction of the mid-axis of the cylinder circumference. A movement of the printing plates through the mid-axis is therefore not necessary in order to supply the printing plate to the process stations.

The object of the invention is further achieved by an apparatus for handling printing plates, having a printing plate holder containing at least two mutually parallel, intercoupled holding decks for printing plates which can be pivoted about a common axis of rotation. The holder is located in the vicinity of process stations for the printing plates and is suitable for transporting at least one printing plate from a first process station to a second process station. All the process stations are disposed on a cylinder circumferential surface about a mid-axis.

By using this apparatus, in particular by using the printing plate holder, the above-described method can advantageously be carried out.

Since the printing plates lie in holding decks, it is particularly beneficial to the method according to the invention that the path starts and ends can be described by respectively independent secants.

A printing plate can be transferred from a first process station in a simple manner on a holding deck in the internal region of the cylinder circumference. This is possible if the holding deck is pivoted up to the process station. According to the invention, the process station and the holding deck then form a section through the cylinder and in this way enable simple transport of the printing plate on to the holding deck. The advantageously pivotable holding deck can be pivoted within the cylinder circumference in such a way that at least one end of the holding deck points to a second process station. Since the process station lies in the direction of a second secant, the printing plate can be transferred from the holding deck into the process station in a simple way.

In a refinement of the apparatus, according to the invention, provision is made for the axis of rotation of the holding deck to coincide with the mid-axis of the cylinder circumferential surface. In a simple way, this achieves a situation where at least one end of a holding deck is always located in the region of the cylinder circumferential surface without the holding deck having to be displaced in any direction. The holding decks also advantageously remain in the interior of the cylinder circumference at every time.

In a further advantageous embodiment, with regard to the apparatus provision is made for the axis of rotation to lie outside the plane of the holding deck and for the holding deck substantially to form a secant through the circle enclosed by the cylinder circumferential surface.

This beneficially makes it possible for the structure to be formed from a section of a cylinder circumference. Given not too large a number of process stations, a complete circle, around which the process stations are located, is normally not needed and in this way space can be saved. This is primarily the case when the entire structure is to be configured in a light-tight manner, which is desirable for printing plates.

In the case of an axis of rotation in the plane of a holding deck, a circumferential surface would always be swept over by pivoting the holding deck, which does not have any advantage in terms of space if the entire cylinder circumferential surface has to be available for process stations. Given an axis of rotation outside the plane, it is possible to sweep over a part of a circle, which is advantageous in terms of space. All the necessary process stations can then be accommodated on the surface of the part cylinder.

As a result of the at least two mutually parallel, intercoupled holding decks of the printing plate holder according to the invention, it is advantageously possible to carry out a further advantageous method step which provides for these two printing plates to be able to be transported substantially simultaneously. The at least two printing plates can be accommodated in the at least two holding decks in this case. They do not have to be transported simultaneously on the same path through the apparatus either. According to the invention, provision can be made for example for a first printing plate to be transported to a first process station and then for a second printing plate to be transferred from a third process station to the printing plate holder while the first printing plate is being fed to a second process station or is still in the first holding deck. It is also possible for there to be a first printing plate, which has been transferred by the input station, in a first holding deck and for the printing plate holder then to be pivoted, so that a second printing plate can be accepted into the second holding deck while the first printing plate is still in the first holding deck.

In a further advantageous method step, provision is made for an alignment of the printing plate to be at least assisted by its own weight.

An alignment method of this type advantageously needs at least less complex displacement mechanisms within the printing plate holder. According to the invention, provision can be made for the alignment to be assisted by the weight, at least in one direction.

In terms of apparatus, provision is made for the holding decks in each case to have two opposite openings, which can be pivoted up to the process stations on the cylinder circumferential surface.

In this way, the space required for the printing plate holder is restricted still further. In order to transport the printing plate from a first process station to a second process station, it is not necessary for the holding deck that has accommodated the printing plate to be pivoted through angles which are greater than 90°. If necessary, the printing plate can then leave the holding deck through the opening that is opposite the side through which the printing plate was picked up.

In an extension to the apparatus, provision is advantageously made for at least one, preferably both holding decks, to have a pivotable stop in order to avoid undesired discharge and for possible alignment of the printing plates.

In order to convey printing plates into a holding deck or out of the latter, the stops can be pivoted out of the path. Advantageously, for the movement of the holding deck, they are pivoted into the path of the printing plates in such a way that the latter cannot slide out of the holding decks, even when in oblique positions. In this case, they will strike the stops. By use of the pivotable stops, alignment of the printing plates can advantageously be at least assisted by their weight. In this case, the holding deck can be pivoted to such an extent that the printing plate begins to slip and slips against the stops and is then aligned on the latter, at least in one direction.

Other features which are considered as characteristic for the invention are set forth in the appended claims.

Although the invention is illustrated and described herein as embodied in a transport apparatus for printing plates and a method of operating the transport apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
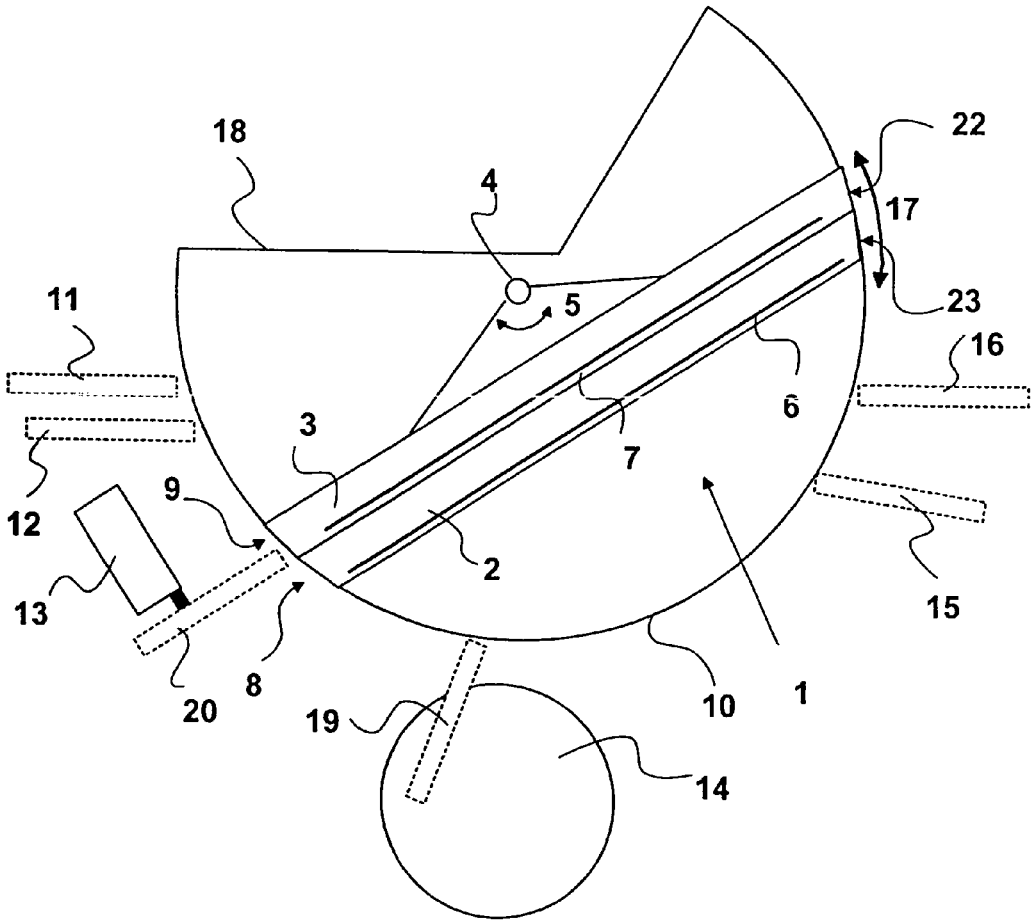
FIG. 1 is a diagrammatic, illustration of a structure of an apparatus according to the invention having a pivotable printing plate holder.

Referring now to the figures of the drawing in detail and first, particularly, to FIG. 1 thereof, there is shown the general structure of an apparatus according to the invention.

A printing plate holder 1 contains two holding decks 2 and 3. The holding decks 2 and 3 are coupled to each other and rigidly connected to an axis of rotation 4. The printing plate holder 1 and therefore the holding decks 2 and 3 can be pivoted about the axis of rotation 4 in a direction of arrow 5.

Printing plates 6 and 7 can be accommodated in the holding decks 2 and 3. The holding decks 2 and 3 have stops 8, 9 and 22, 23, with which the openings of the holding decks 2 and 3 can be closed. In this illustration, the holding decks 2, 3 are closed by the stops 8, 9 and 22, 23.

Around the printing plate holder 1, a plurality of process stations 11 to 16 are disposed around a surface 10. The surface 10 is not of a material nature, it encloses a part cylinder that is formed by the possible positions of the printing plate holder 1. The printing plate holder 1 can select the different process stations 11 to 16 by pivoting the holding decks 2 and 3 in the direction of arrow 17. The surface 10 therefore constitutes at least a section of a cylinder circumferential surface. Still further process stations in addition to the process stations 11 to 16 can additionally be provided on the surface 10.

The printing plate holder 1 is enclosed by elements, not further illustrated here, which protect against the irradiation of light and help to avoid persons intervening in the interior of the structure. Toward the top, it can be limited by a cover 18, for example.

The process stations 11 to 16 are substantially represented by a dashed transport path of the printing plates 6 and 7 outside the printing plate holder 1.

The process stations 11 and 12 are intended here to be input and output stations: the manual input station 11 and the manual output station 12.

The process stations 15, 16 represent the input and output stations for automatic loading and discharge of the printing plate holder: the automatic output station 16 and the automatic input station 15. The input station 15 is adjoined, for example, by a non-illustrated SCL. The SCL then separates printing plates 6, 7 from a non-illustrated cassette, and then supplies them to the printing plate holder 1. If the printing plates 6, 7 are conveyed out of the printing plate holder 1, they can then be transported via the automatic output station 16 by a non-illustrated automatic transport system. For this purpose, the transport system can, for example, have rolls for the purpose of the printing plate transport.

The process station 14 is here intended to represent an image setting device 14 for imaging the printing plates 6, 7. The printing plates 6, 7 can be supplied to the image setting device 14 via a printing plate feed 19. In the image setting device 14, the printing plates 6, 7 are then clamped on and can be imaged.

The process station 13 represents a punching apparatus 13 for punching register holes into the printing plates 6, 7. It has a printing plate feed 20 for feeding printing plates 6, 7 into the punching apparatus 13.

Further process stations, not illustrated here, can be, for example, development stations for developing the imaged printing plates 6, 7.

It is possible for further devices, for example development devices for treating the printing plates 6, 7, also to be provided downstream of the non-illustrated transport system, and, following transfer to the automatic output station 16, to be led to these. Then, following the treatment in one of these devices, the printing plates 6, 7 can be supplied to the printing plate holder 1 again, for example, the input station 15. In particular, the output station 16 can also be configured in such a way that it can also function as an input station and can thus supply the printing plates 6, 7 to the printing plate holder 1 as well. It is then able, for example, to transfer the printing plates 6, 7 to the printing plate holder 1 again from the further devices following a treatment.

FIGS. 2 to 7 show the printing plate holder 1 during a method for handling the printing plates 6, 7. It is shown how the printing plates 6, 7 are picked up in the holding decks 2 and 3 via the manual input station 12, how the stop 8 closes the holding deck 2 and how the printing plate 1 is then pivoted into a position for the partial alignment of the printing plate 6 and to pick up the printing plates 7 from the image setting device 14. The printing plate holder 1 is then pivoted into a position from which the printing plate 6 can be transferred to the image setting device 14. Following this, further pivoting is carried out, so that the printing plate 7 can be transferred to the punching apparatus 13 and register holes can be punched there. Finally, the printing plate holder 1 is pivoted through an angle which is sufficient for the second opening of the holding deck 3 to adjoin the automatic output station 16, and the printing plate 7 can be transferred here.

Figure 8:
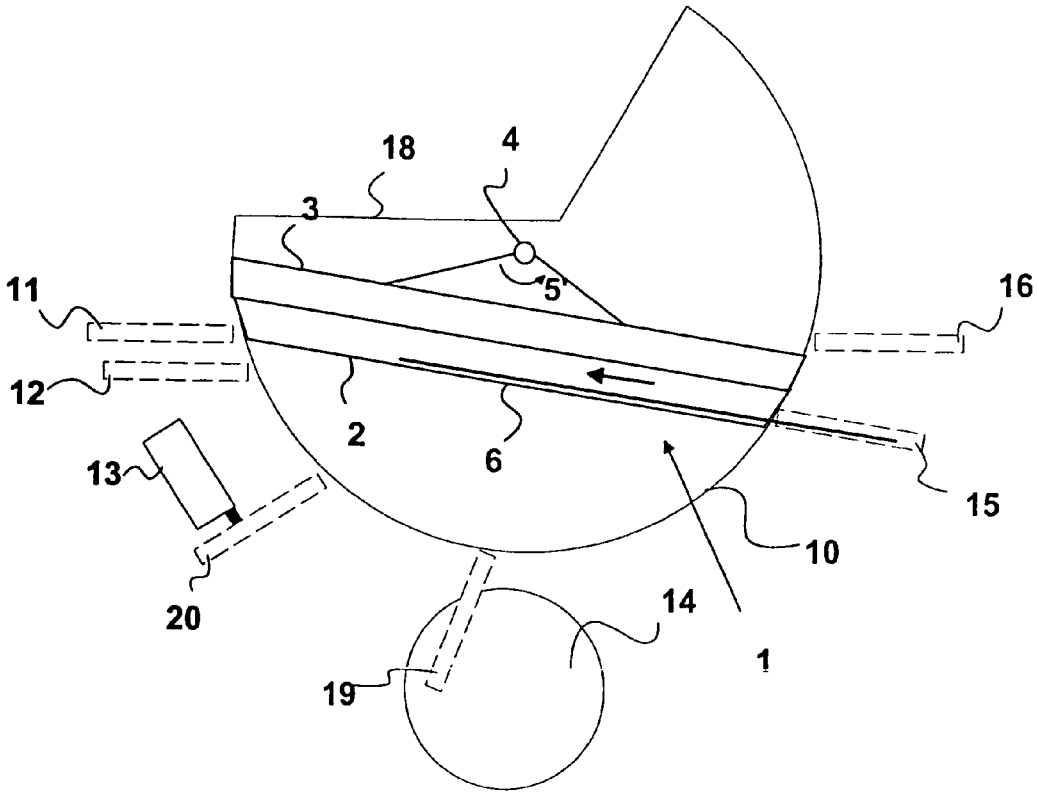
FIG. 8 is an illustration of the printing plate holder during alternative loading via an automatic input station.

Alternative methods are also possible. In particular, automatic loading via the input station 15 and manual removal via the manual output station 11, and also any desired combinations between manual input and output and automatic input and output of the printing plates 6, 7. Appropriate alternative loading of the printing plate holder 1 via an automatic input station 15 is shown in FIG. 8.

Figure 2:
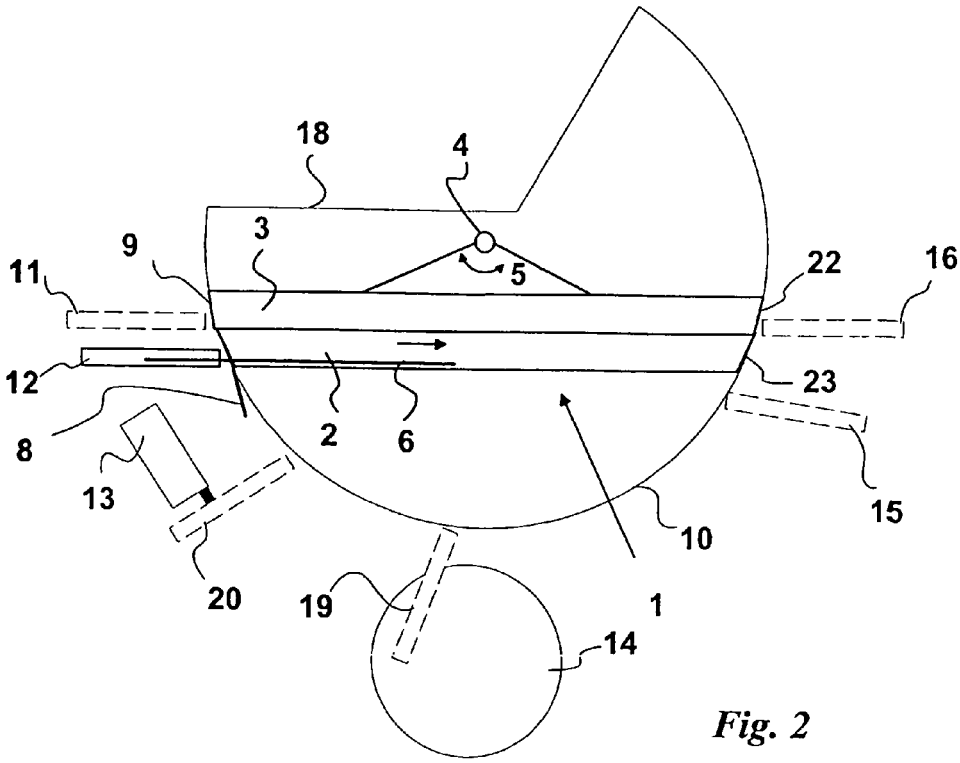
FIG. 2 is an illustration of the printing plate holder from FIG. 1 during the loading of the printing plate holder with a first printing plate.

In FIG. 2 the stop 8 has been pivoted away, so that the printing plate 6 can be guided into the holding deck 2. For this purpose, according to the invention the stop 8 can also be lowered into the holding deck 2. The illustrations selected here are used more for improved clarity. For the purpose of loading, the printing plate 6 is pushed in manually via the input station 12. According to the invention, the input station 12 can run horizontally with respect to the floor, then enclosing an angle of 0° to a horizontal. Other angles can also be possible, depending on the exact position of the process station on the surface 10. The angles of the process stations 11 to 16 illustrated in the drawings are intended to apply only symbolically and also only to indicate a rough relationship.

Figure 3:
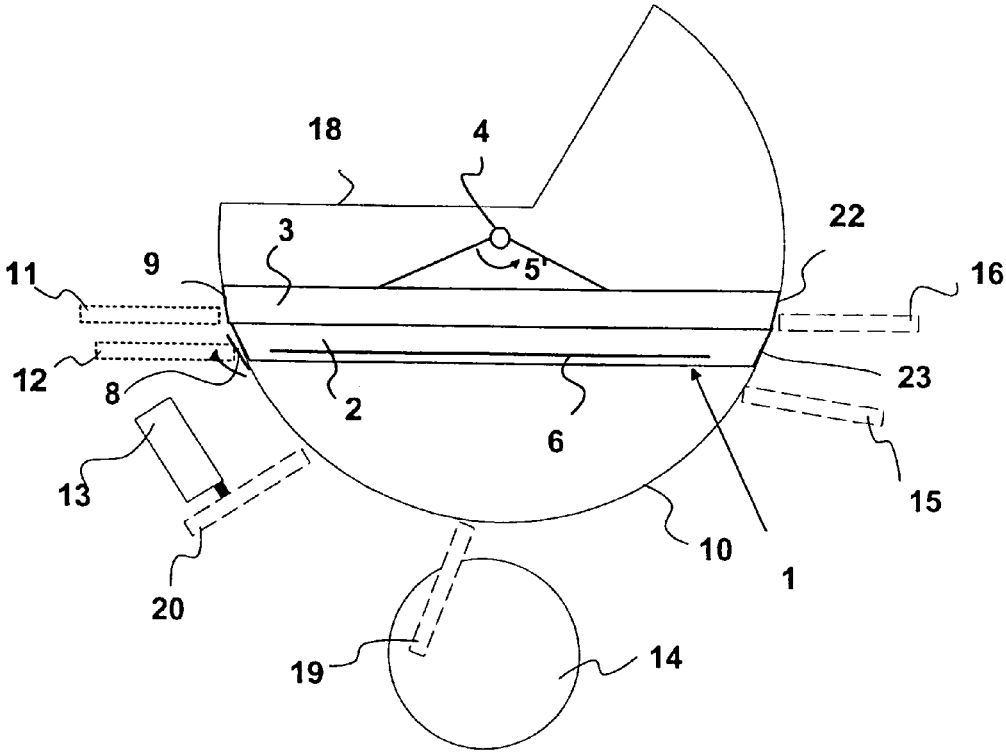
FIG. 3 is an illustration of the printing plate holder with the first printing plate loaded and with the stop closing.

Within the holding deck 2 there is a non-illustrated suction carriage. It accepts the printing plate 6 inserted, for example in response to the user pressing a button, and transports it into a rear region of the holding deck 2. The stop 8 is then pivoted in front of the opening of the holding deck 2. The closing operation is illustrated in FIG. 3. The stop 8 additionally secures the plate 6 against inadvertent discharge.

The printing plate 6 is moved into the region of a light barrier within the holding deck 2 and, after the printing plate 6 has been detected by the light barrier, is moved forward again into a further light barrier. The format of the printing plates can be determined on the basis of the distance traveled. The light barriers are not illustrated here. Following the format detection, the printing plate 6 is released by the suction carriage.

Figure 4:
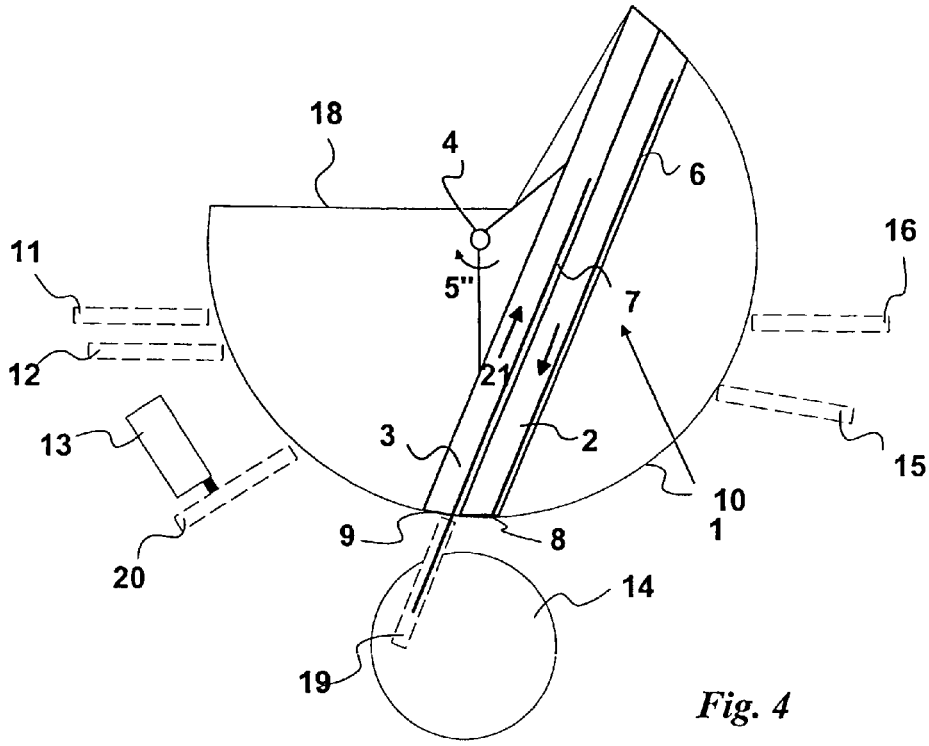
FIG. 4 is an illustration of the printing plate holder when picking up a second printing plate from an image setting device and with simultaneous alignment of the first printing plate.

In FIG. 4 the printing plate holder 1 has been pivoted through an angle of, for example, 63° in the direction of arrow 5' from FIGS. 2 and 3. This angle is selected such that the weight of the printing plate 6 is at least sufficient to overcome the friction with the base of the holding deck 2. The printing plate 6 then slips against the closed stop 8 and is aligned here as a result of its own weight.

Also accommodated in the holding deck 2 is a centering apparatus, not further illustrated here either. It can, for example, correspond to a centering apparatus as has been proposed in Published, Non-Prosecuted German Patent Application DE 101 28 057 A1, corresponding to U.S. Pat. No. 6,698,573. By use of the centering apparatus, the printing plate 6 can then be aligned relative to the image setting device 14.

The image setting device 14 is located on the surface 10 at a position which makes it possible, at the angle which is selected in order to align the printing plates 6, therefore 63° in this case, for the printing plate 7 to be transferred from the image setting device 14 to the holding deck 3. For this purpose, the stop 9 of the holding deck 3 is pivoted to such an extent that loading becomes possible. The printing plate 7 is then accepted by a non-illustrated suction carriage, after it has been pushed at least partly on to the holding deck 3 by the image setting device 14. The suction carriage then pulls the printing plate 7 completely into the holding deck 3 in the direction of arrow 21 and the stop 9 is closed again.

Figure 5:
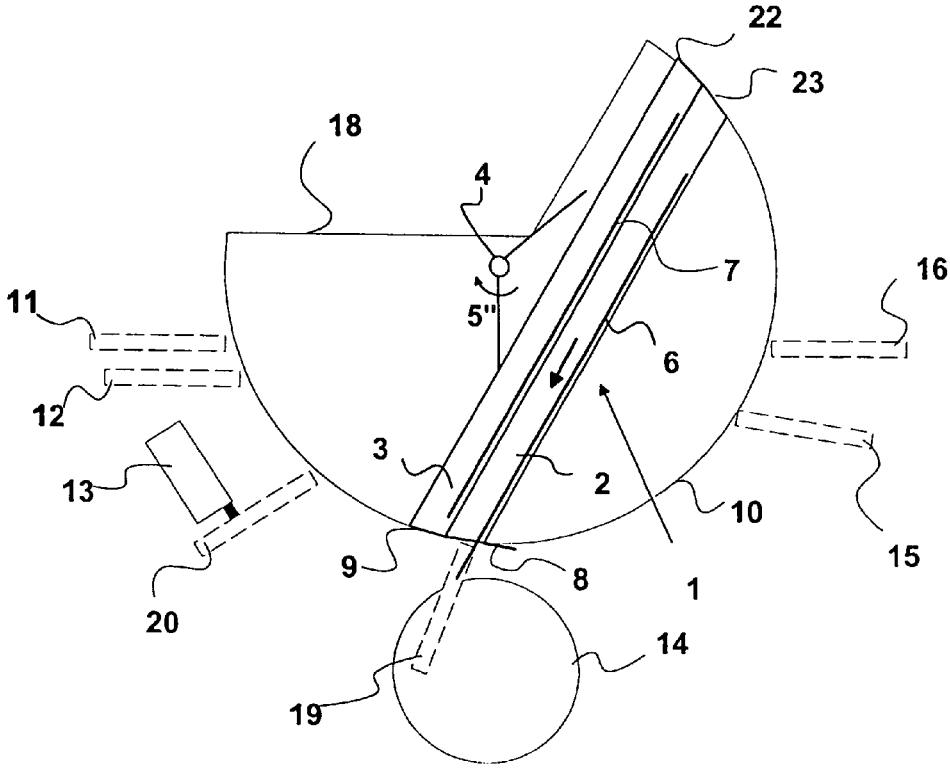
FIG. 5 is an illustration of the printing plate holder during the discharge of the first printing plate in order to be clamped in an image setting device.

The printing plate holder 1 is then pivoted in the direction of the arrow 5" into the position that it assumes in FIG. 5. The angle is about 53° here.

The stop 8 of the holding deck 2 adjoins the printing plate feed 19 of the image setting device 14. It is then pivoted up again and the printing plate 6 is transported out of the holding deck 2 into the image setting device 14 by the suction carriage. If the exposure device 14 is, for example, an external drum exposer, provision can be made for the distance by which the printing plate is pushed into the image setting device of 14 to be 20 cm, so that the end of the printing plate 6 is located just in front of contact pins, not shown here, in an opened clamping bar, not shown here either. The suction carriage then releases the printing plate 6, which is placed on the contact pins as a result of the force of gravity. The clamping bar then closes and the printing plate 6 is clamped in the image setting device 14. The clamping of the printing plate 6 in the exposer device 14 can also differ according to the type of image setting device 14. Following the transfer of the printing plate 6, the stop 8 is pivoted again, so that the holding deck 2 is closed.

If there was no printing plate 7 in the image setting device 14, there is now no printing plate 7 in the holding deck 3 either, the printing plate holder 1 is then pivoted in the direction of the arrow 5" to such an extent that it assumes the position from FIG. 2, in order then to accept a possible first printing plate 6.

Figure 6:
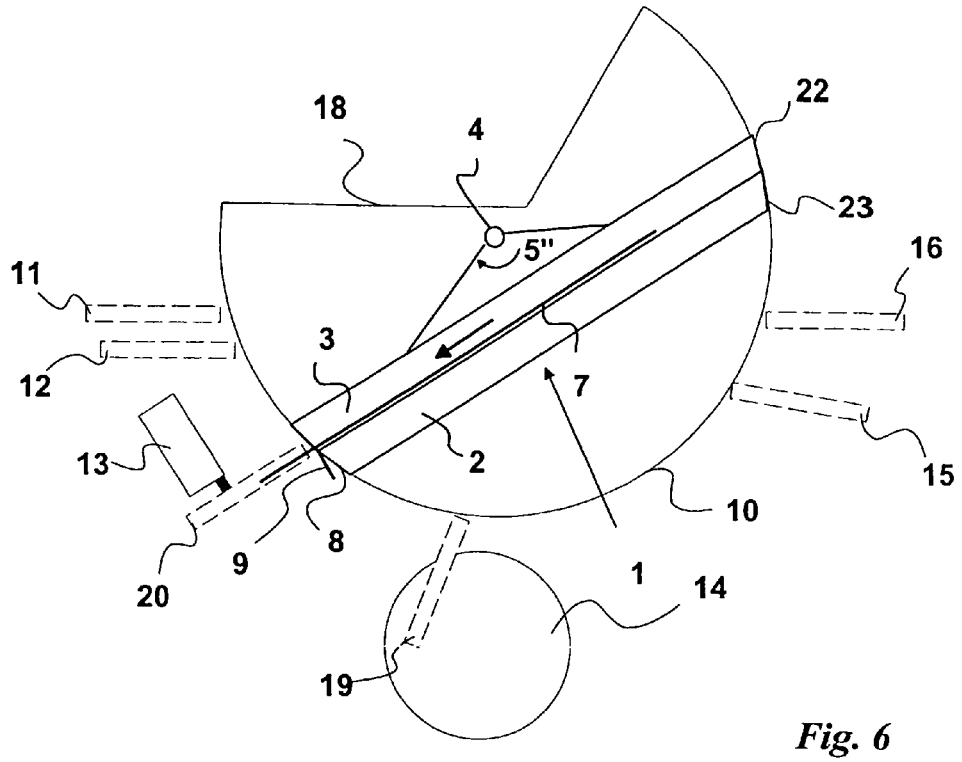
FIG. 6 is an illustration of the printing plate holder during the transport of the second printing plate into a punching apparatus.

However, if there is a printing plate 7 in the holding deck 3, then the printing plate holder 1 is pivoted in the direction of the arrow 5" to such an extent that the stop 9 is located in front of the printing plate feed 20 of the punching apparatus 13. This position of the printing plate holder is illustrated in FIG. 6.

The angle with respect to the horizontal can be 39°, for example, here. The stop 9 is opened and the suction carriage grips the printing plate 7 and leads it up to the contact pins of the punching apparatus 13. This can be, for example, a distance of 100 mm, so that the distance between the contact pins and the printing plate 7 is about 1 mm. The suction carriage then releases the printing plate 7. The latter is then aligned on the contact pins of the punching apparatus 13 by its own weight and can also be aligned laterally by a centering apparatus provided in the punching apparatus 13. In order to assist the centering of the printing plates 7, provision can be made for there to be flow holes in the bottom of the holding deck 3 in order to form an air cushion underneath the printing plate 7. Air is pressed through these flow holes, so that an air cushion is formed, on which the printing plate 7 can slide easily. In this way, the centering of the printing plate 7 in the punching apparatus 13 can be carried out in a straightforward manner, since there is only little frictional resistance. Register holes, which are used for clamping the printing plate 7 in a press, are then punched into the printing plate 7. The printing plate 7 is then accepted by the suction carriage again and pulled into the holder deck 3, the stop 9 is pivoted shut and the printing plate holder 1 is pivoted in the direction of the arrow 5' until it assumes the position illustrated in FIG. 7.

Figure 7:
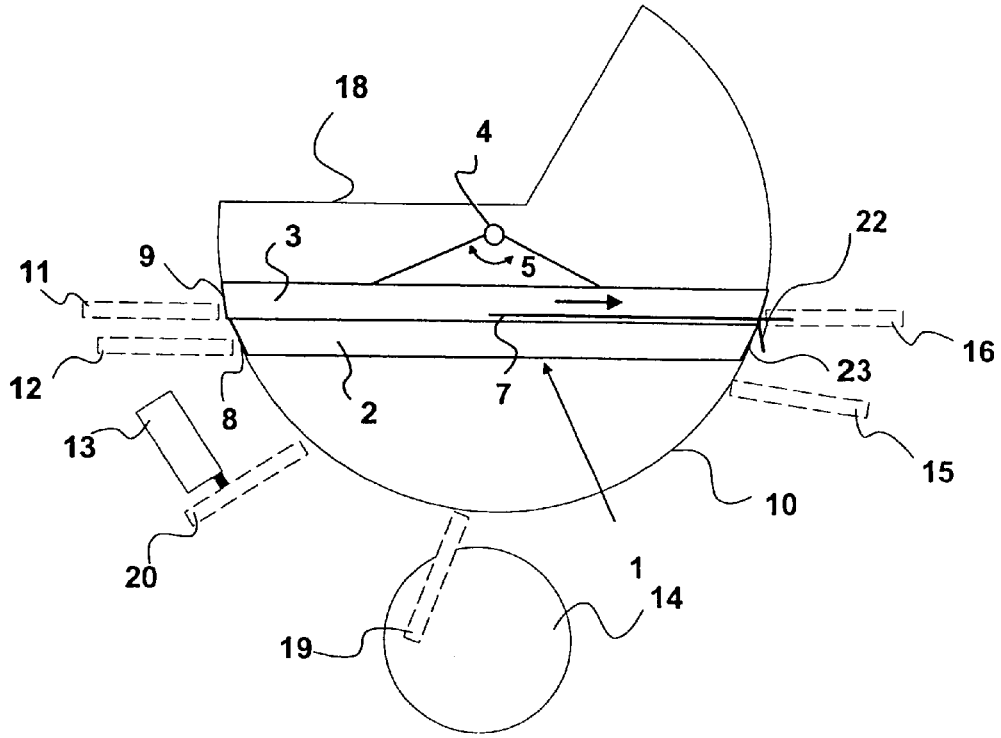
FIG. 7 is an illustration of the printing plate holder during a transfer of the second printing plate into an automatic output station.

The printing plate holder 1 assumes an angle of 0° with respect to the horizontal in FIG. 7. The stop 9 then adjoins the manual output station 11. On the opposite side, the holding deck 3 with the stop 22 adjoins the automatic output station 16. In the case illustrated here, the stop 22 is pivoted away and the printing plate 7 is transferred by the suction carriage to non-illustrated rolls, belonging to the automatic output station 16. Of course, is also possible for the printing plate 7 to be output via the manual output station 11. For this purpose, the printing plate 7 is transferred into the manual output station 11, the stop 9 being opened previously.

The holding decks 2 and 3 in each case have at both ends sensors which are able to detect printing plates 6 and 7 in the region of the stops 8, 9 and 22, 23 and, if appropriate, arrange for the stops to be pivoted away.

If automatic loading of the printing plate holder 1 is to be carried out, for this purpose the printing plate holder 1 must be pivoted such that the stop 23 is located in front of the automatic input station 15. The angle with respect to the vertical should then be around −10°, which means that the stop 8 is located above the manual input station 11. This position is illustrated in FIG. 8. The printing plate 6 is then transported, by non-illustrated transport devices belonging to the input station 15, at least sufficiently far into the holding deck 2 that the suction carriage can perform the further transport. Further method steps can then correspond to those shown in FIGS. 3 to 7.

In the event of manual loading, the printing plate holder 1 can remain in the discharge position which it has assumed in FIG. 7, and the next printing plate 6, as described in the case of FIG. 2, can be inserted into the holding deck 2. The rest of the method is then repeated as described.

It is also possible to dispense with individual steps in the method described. For example, a printing plate 7 transported out of the image setting device 14 can also be transported straight into the automatic output station 16 without being punched. In particular, it is also possible for a printing plate 6 loaded in via the manual input station 11 to be supplied directly to the automatic output station 16 without being treated in further process stations on the surface 10.

This application claims the priority, under 35 U.S.C. § 119, of German patent application No. 103 59 667.4, filed Dec. 18, 2003; the entire disclosure of the prior application is herewith incorporated by reference.

I claim:

1. An apparatus for handling printing plates, comprising:

a printing plate holder having at least two mutually parallel, intercoupled holding decks for receiving the printing plates, said holding decks being pivotable about a common axis of rotation, said printing plate holder being located in a vicinity of process stations for further processing the printing plates and being suitable for transporting at least one printing plate from a first process station to a second process station, all the process stations being disposed around a cylinder circumferential surface about a mid-axis.

2. The apparatus according to claim 1, wherein said common axis of rotation of said holding decks coincides with said mid-axis of said cylinder circumferential surface.

3. The apparatus according to claim 2, wherein said common axis of rotation lies outside a plane of said holding decks and said holding decks are substantially formed by a secant through a circle enclosed by said cylinder circumferential surface.

4. The apparatus according to claim 3, wherein said holding decks in each case have two opposite openings formed therein, said openings can be pivoted up to the process stations disposed around said cylinder circumferential surface.

5. The apparatus according to claim 1, wherein at least one of said holding decks has at least one pivotable stop for avoiding inadvertent discharge and for possible alignment of the printing plates.

6. The apparatus according to claim 1, wherein said holding decks each have at least one pivotable stop for avoiding inadvertent discharge and for possible alignment of the printing plates.

7. The apparatus according to claim 1, wherein one of the processing stations is an image setting device for imaging the printing plates.

* * * * *